US005355768A

United States Patent [19]

Felk

[11] Patent Number: 5,355,768

[45] Date of Patent: Oct. 18, 1994

[54] AUTOMATIC PISTOL WITH SELECT FIRE MECHANISM

[76] Inventor: Edward K. Felk, 126 Skye Pt. Rd., Coal-Point NSW 2282, Australia

[21] Appl. No.: 63,543

[22] Filed: May 19, 1993

[30] Foreign Application Priority Data

Aug. 19, 1992 [AU] Australia ..... PL4253,35498/93

[51] Int. Cl.[5] ..... F41A 19/38

[52] U.S. Cl. ..... 89/147; 89/141; 89/148; 89/137

[58] Field of Search ..... 42/70.02, 70.04, 70.06; 89/137, 141, 145, 147, 148

[56] References Cited

U.S. PATENT DOCUMENTS 3,678,800 7/1972 Seidel et al. ..... 89/147

FOREIGN PATENT DOCUMENTS 680451 9/1939 Fed. Rep. of Germany ..... 42/70.02
2263888 7/1973 Fed. Rep. of Germany ..... 42/70.06
46883 10/1936 France ..... 42/70.02

OTHER PUBLICATIONS

Webster's Seventh New Collegiate Dictionary, "breech", breechblock, 1963, p. 104.

*Primary Examiner*—Stephen C. Bentley

[57] ABSTRACT

A select fire automatic pistol comprising: a frame; a slide with a breech-block in the rear which slides on the frame over the barrel to form a cartridge receiving chamber; a floating barrel in the slide having a cartridge receiving rear; a trigger safety lever for preventing the movement of the trigger to the activating position; a magazine drop safety to stop the trigger moving to the activated position when the magazine is not fully seated; a trigger bar connected to the trigger including an ledge for displacement of the firing pin backwards to the rear position; a firing pin including a foot on its rear for engagement with the trigger bar ledge and having a spring threadled on the rear of the firing pin for propelling same forward into the cartridge chamber to fire a cartridge and a spring threadled on the front of the firing pin urging same backwards to stop it entering the cartridge chamber if the pistol is dropped; an ejector plate to eject the empty shells, create a safety zone and stabilize the ledge of the trigger bar; an activating rod for engagement with the inclined edge of the trigger bar for displacement of the firing pin foot out of operative engagement with the trigger bar ledge when the trigger is moved into the activated position and to allow the trigger bar ledge to be lifted up into the path of the firing pin foot for engagement with the trigger bar ledge into the ready position; an extractor, to extract an empty cartridge, which automatically snap locks itself in its cavity in the breech-block; a select fire switch to select between semi-auto mode or the full-auto mode.

10 Claims, 3 Drawing Sheets

FIG 5
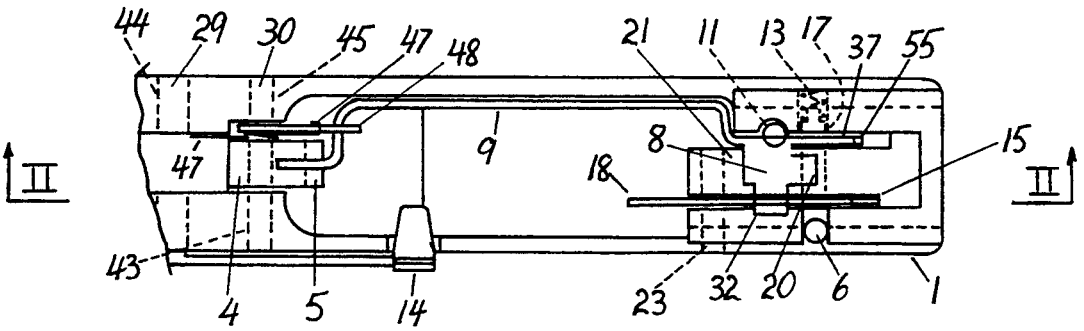
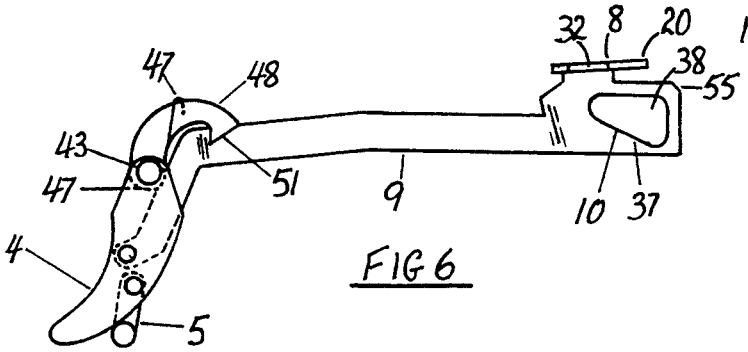
FIG 6
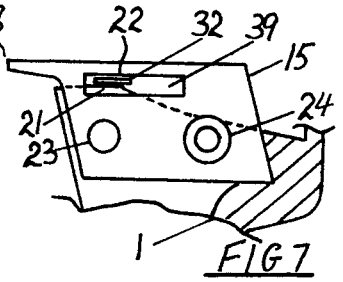
FIG 7
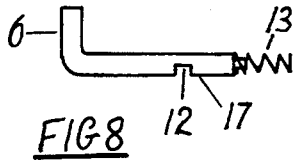
FIG 8
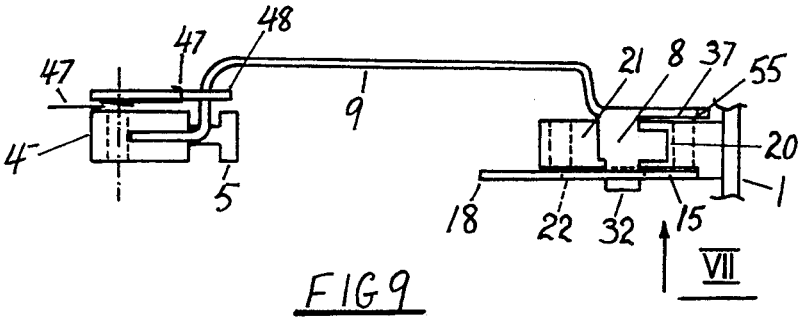
FIG 9
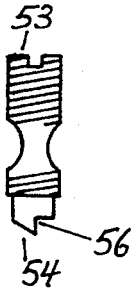
FIG 10

AUTOMATIC PISTOL WITH SELECT FIRE MECHANISM

FIELD OF THE INVENTION

This invention relates to automatic pistols of the type which automatically eject the spent cartridge and chamber a new one after each shot.

BACKGROUND OF THE INVENTION

It is known that automatic pistols usually require many parts to manufacture them and make them function safely. They are usually complicated to handle and prone to accidental discharges if jarred when the pistol is loaded and cocked in ready to fire condition, thus requiring an external safety to prevent the pistol from discharging accidentally. The above makes the pistol hard to handle and costly to manufacture without the added advantage of a select fire mechanism.

OBJECT OF THIS INVENTION

It is therefore the object of this invention to provide an improved pistol which is easy to use, requires a small number of parts to make it function, is safe to handle, can be produced at a very low cost and by adding just one extra part can be made into a select fire pistol.

SUMMARY OF THE INVENTION

This object is attained with this invention of a pistol which comprises a frame with a magazine receiving rear, a floating barrel with a cartridge receiving rear, and a slide with a breech-block in the rear which slides on the frame and engages over the barrel to form a cartridge chamber. The firing pin is movable in the breech-block with a strong spring threadled on the rear and braced against same to propel said firing pin from the cocked position into the cartridge chamber to fire the cartridge. A relatively weak spring is threadled on the front of the firing pin to urge same backwards in order to stop the firing pin entering the cartridge chamber when the pistol is dropped and to return it back into the breech-block after a shot has been fired. It is not strong enough to stop the firing pin entering the chamber when propelled by the strong propelling spring.

The trigger pivots in the frame and moves between the inactivated and activated positions. It includes a trigger safety lever which pivots on the back of the trigger to form a barrier between the trigger and the frame which stops the travel of the trigger to the activated position when the safety lever is engaged. There is also a magazine drop safety plate which includes a hook to engage over the trigger bar to prevent the movement of same when the magazine is fully or partially out of the frame. The trigger bar is connected to the trigger and has a ledge to engage the firing pin foot as it moves into the ready position for displacement of the firing pin backward into the rear position by moving the trigger to the activated position. In the rear position the ledge disengages from the firing pin foot which allows the firing pin to be propelled forward into the cartridge chamber to fire the shot and then return into the ready position.

The activating rod is transversely movable in the frame, has a foot on one end and a spring provided on the opposite end. It includes a groove in said rod for controlling the engagement and disengagement of the trigger bar ledge into and out of the path of the firing pin foot. Similarly when in the full-auto mode the inclined edge provided on the select fire switch controls the trigger bar ledge into and out of the path of the firing pin foot automatically as long as the trigger is held in the actuated position.

According to this invention the ready position for the firing mechanism is such that there is no compression of the propelling spring, therefore it is impossible for the pistol to discharge if the pistol is dropped. In other words, the ready position of the pistol is the uncocked condition. The cocking of the pistol for each shot is effected by the movement of the trigger to the activated position thus the condition of the pistol is the same for all shots. In this invention the ejector plate, when fitted into its place, co-acts with an upward projecting ledge in the frame adjacent to the ejector plate to form a safety zone for the trigger bar web and wing so it is impossible to disengage the trigger bar ledge off the firing pin foot preventing the possibility of an inactive trigger if the pistol is dropped or jarred. The pistol cannot discharge if dropped when it is in the ready (safety zone) condition as the pistol is uncocked whether it is in the semi-auto mode or the full-auto mode.

According to this invention the extractor automatically snap locks itself in its cavity in the breech-block.

According to this invention handling of the pistol is very simple. The pistol is ready for firing after chambering a cartridge and is completely safe even if the safety lever on the trigger is not engaged. Similarly because of the uncocked condition of the pistol, it is drop and jar-proof. With this invention a very small number of parts are required to produce the pistol. The frame is manufactured in one piece out of synthetic resin and the slide, barrel, firing pin and some of the minor parts out of steel. Therefore, manufacturing of the pistol is inexpensive and simple. Because of the pistol's simplicity and light weight it is very easy to use compared with pistols made entirely from metallic parts.

DESCRIPTION OF THE DRAWINGS

FIG. 5 is a top view of detail of FIG. 2 below section line III, line II being the section plain for FIG. 2.

FIG. 6 is a side view of the trigger mechanism of the pistol of FIG. 1.

FIG. 7 is a view of detail in the direction of the arrow of FIG. 9.

FIG. 8 is a side view of the activating rod of the pistol for FIG. 1.

FIG. 9 is a top view of the detail in FIGS. 6 and 7.

FIG. 10 shows the detail of the select fire switch.

SPECIFIC DESCRIPTION

Figure 1:
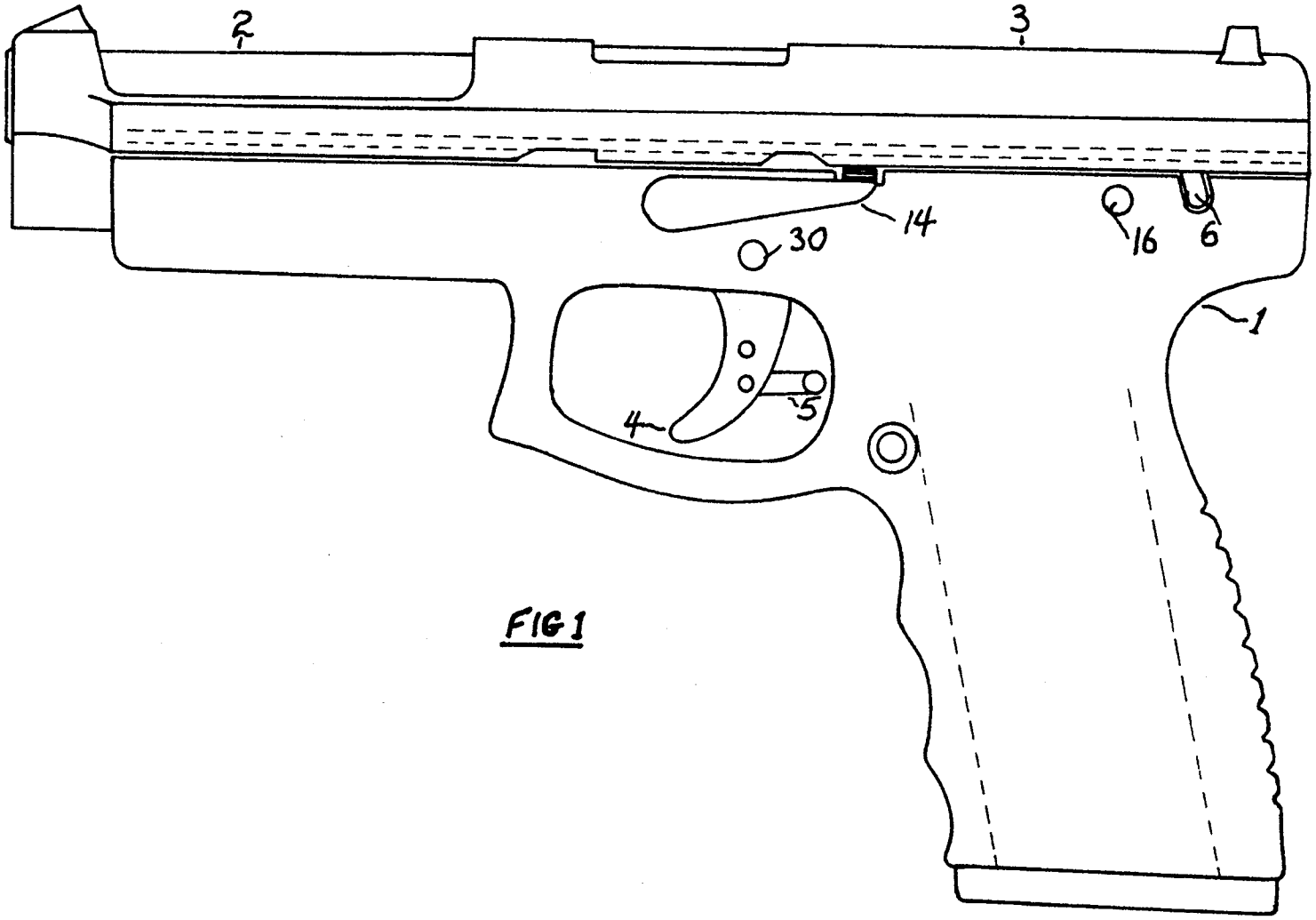
FIG. 1 is a side view of the pistol according to the present invention.
Figure 2:
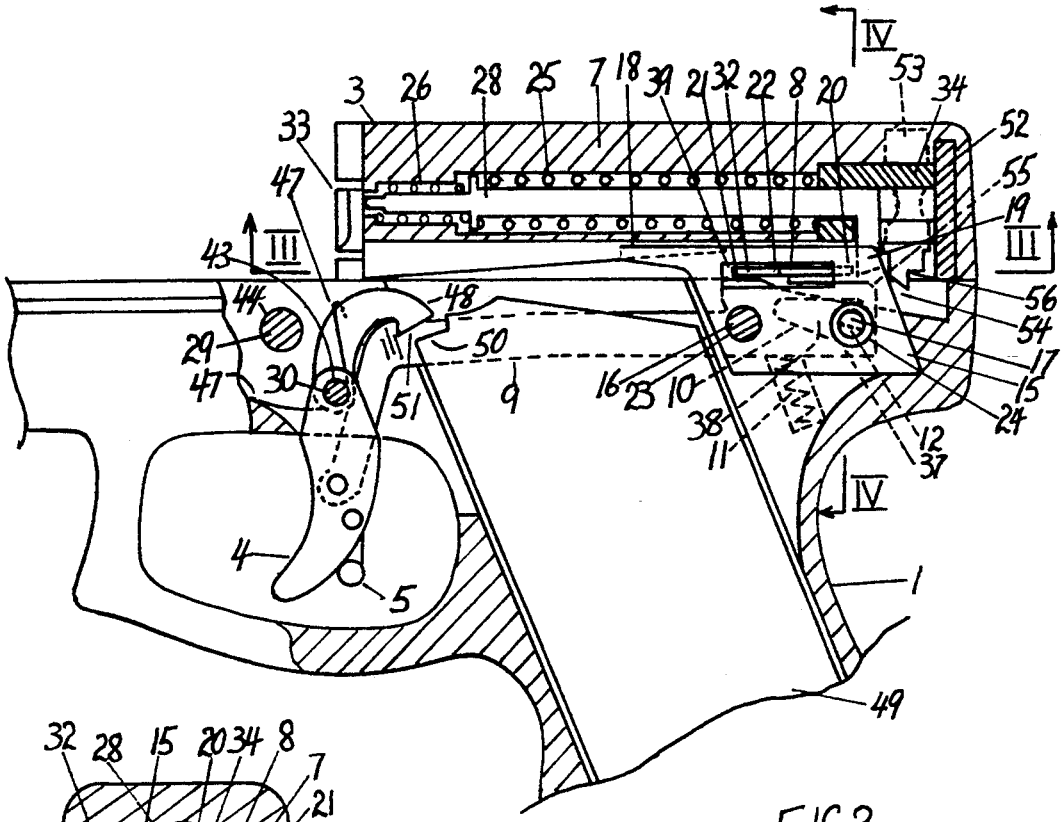
FIG. 2 is a LONGITUDINAL section through the firing mechanism of the pistol of FIG. 1.
Figure 4:
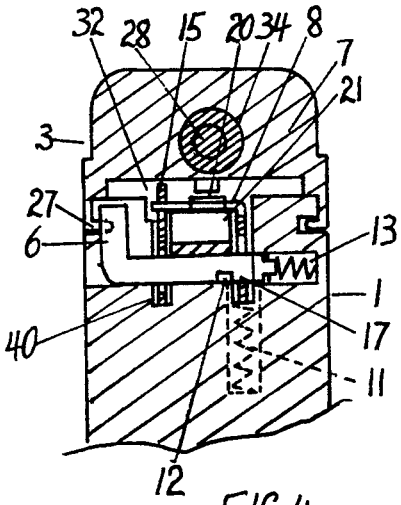
FIG. 4 is a cross sectional view of detail in front of section line IV of FIG. 2.
Figure 11:
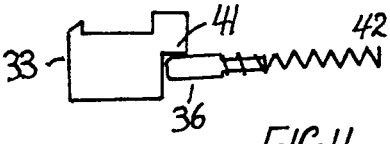
FIG. 11 is a detail view of the extractor assembly.
Figure 3:
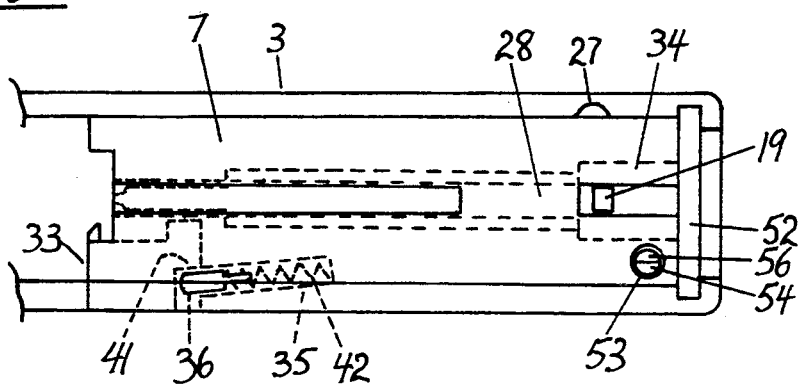
FIG. 3 is a bottom view of the breech of FIG. 2 above section line III.

In FIG. 1 it can be seen the pistol comprises of a frame (1) and a slide (3) which slides on the frame (1) and a floating barrel (2) mounted inside the slide (3) with the breech a block (7) at the rear of the slide (3). The trigger (4) has a safety lever (5) pivoting on the back of the trigger (4), so when the lever (5) is rotated upwards 90° to the trigger (4) it creates a barrier between the frame (1) and the trigger (4) to prevent activation of the trigger.

FIGS. 2 to 11 show the firing mechanism of this invention wherein a trigger bar (9) is pivotally connected to the trigger (4). On the rear of the trigger bar (9) is a web (8) with a wing (32) projecting sideways to stabilise the trigger bar ledge (20) which projects backwards from the web (8) to engage with the firing pin foot (19). A triangular hole (38) in the plate (37) of the trigger bar (9) is provided with an inclined edge (10) to co-act with the activating rod (17) and groove (12) in said rod (17). Similarly the fire select switch (53) is provided with an inclined edge (54) to co-act with the face (55) of the trigger bar when the switch (53) is turned to the full-auto mode. When in the semi-auto position a cut away (56) next to the inclined edge (54) is positioned longitudinally to the pistol allowing the face (55) of the trigger bar to pass through the cutaway (56) without contact with the edge (54). The activating rod (17) has a foot (6) on one end to co-act with a groove (27) cut in the underside in the slide (3). The spring (13) provided on the opposite end of the activating rod (17) returns same to its original position. The ejector plate (15) co-acts with the ledge (21) to create a safety zone and stabilise the trigger bar (9) by entrapping the web (8) and wing (32) between the ledge (21) below the web (8) and the edge (22) of the rectangular hole (39) above the wing (32). This safety zone is created when the ejector plate (15) is fitted into a slot (40) adjacent to the ledge (21) in the frame (1). The firing pin (28) has a foot (19) on the rear to engage the ledge (20). A strong spring (25) is threadled on the rear of the firing pin (28) for propelling same into the cartridge chamber.

A weak spring (26) is threadled on the front of the firing pin (28) to prevent same entering the cartridge chamber if the pistol is dropped accidentally. It also pushes the firing pin back into the breech-block (7) after firing the pistol. The extractor (33) clips into place after the spring (42) and the follower (36) are placed into the blind hole (35) in the slide (3). When the extractor (33) is in place the follower (36) springs back over the ledge (41) of the extractor locking same in the breech-block (7).

When the slide (3) is pulled back the activating rod (17) is forced out of the groove (27) in the slide (3) and moves transversely in the frame (1) positioning the groove (12) of the activating rod (17) over the inclined edge (10) in the trigger bar plate (37) allowing the ledge (20) to be lifted up into the path of the firing pin foot (19) when edge (10) enters the groove (12) urged by the spring (11) provided under the plate (37) of the trigger bar (9). When the slide (3) moves forward the firing pin foot (19) engages the ledge (20) and at the same time moves same forward to entrap the web (8) and the wing (32) in a narrow safety zone holding the web (8) and the wing (32) firmly in it. As the slide (3) returns to the forward position and locks against the barrel (2) the activating rod foot (6) is returned into the groove (27) in the slide (3). The pistol is now in the ready position and uncocked.

In semi-auto mode, when the trigger (4) is pulled it moves the trigger bar (9) and the ledge (20) pushes the firing pin foot (19) compressing the propelling spring (25) to cock the firing pin (28). Meanwhile the inclined edge (10) has connected with the activating rod (17) gradually pulling the web (8) and the ledge (20) down. When the web (8) and the wing (32) have moved out of the safety zone the firing pin foot (19) disengages from the ledge (20) to allow the firing pin (28) to be propelled into the cartridge chamber to fire the shot. When the slide (3) is moved backwards by the recoil forces of a shot the cycle is repeated. When the pistol is in the full-auto mode the inclined edge (54) of the switch is positioned into the path of the trigger bar face (55). When the trigger (4) is pulled the activating rod (17) controls the trigger bar ledge (20) as described in semi-auto mode. After the first shot fires, if the trigger is held in the actuated position, the disengagement of the ledge (20) for the second and subsequent shots is controlled by the inclined edge (54) co-acting with face (55) on the trigger bar plate (37). As the face (55) strikes the edge (54) it pushes the ledge (20) downwards to disengage it from the firing pin foot (19) allowing the firing pin (28) to enter the cartridge chamber. When the slide (3) is in the rear position the trigger bar ledge (20) is lifted upwards urged by the spring (11) under plate (37) ready to be engaged by the foot (19). When the slide (3) reaches the forward position the face (55) is pushed downwards as it strikes the inclined edge (54) disengaging the ledge (20) off the foot (19). This action continues automatically as long as the trigger (4) is held in the actuating position. When the trigger (4) is released the ledge (20) returns to the safety zone, the cycling stops and the pistol is in the ready condition and uncocked. If the slide (3) is not fully locked forward the activating rod foot (6) cannot enter the groove (27) in the slide (3) which means that the groove (12) remains over the inclined edge (10) preventing same from connecting with the activating rod (17). In this condition activating the trigger (4) will not release the firing pin foot (19) thus preventing the pistol being fired. Similarly when the slide (3) is not locked while in the full-auto mode the inclined edge (54) cannot connect with the face (55) therefore preventing the disengagement of the trigger bar ledge (20) off the firing pin foot (19), preventing further firing of the pistol.

Another safety feature is that the magazine drop safety plate (48) has a hook (51) on one end and pivots on the trigger locating pin (30). It includes a spring (47) which urges the safety plate (48) to engage the trigger bar (9) with the hook (51) to prevent the movement of the trigger bar rearward when the magazine (49) is partially or fully out of the frame (1). When the magazine (49) is correctly seated in the frame (1) the ledge (50) on the magazine (49) engages the hook (51) and forces it upward to disengage it from the trigger bar (9). This allows the trigger bar (9) to move freely in the frame. This invention is not limited to the advantages described above. The simplicity of production of the pistol components is a major advantage.

According to this invention the pistol can be produced at a very low initial tooling up and production cost per unit.

According to this invention the one piece plastic frame (1), including all holes, cavities and slots, can be produced in one operation. There are also advantages in the assembly of the pistol, because of the low number of parts. The pistol can be assembled from components in just a few minutes at the production level. For example the extractor (33) only needs to be pushed into its cavity and the retaining of same is automatic. A further example of the advantages of the design is the way the assembled ejector plate (15) co-acts with the ledge (21) in the frame (1) to create the safety zone. The slot (40) and the ejector (15) are so designed that it requires only one pin

(16) to lock the ejector plate into place. Only three small press tools are required to produce the trigger bar (9) and the ejector plate (15). One mould is needed to produce the frame (1), and all the plastic parts, the rest is manufactured by simple machining. In this invention by the inclusion of just one part, the select fire switch (53), the pistol becomes a select fire pistol. The select fire switch (53) is not limited to a screw type switch, it can be a lever similar to a safety lever as used on single action semi-auto pistols. This design produces an easy to use and very safe select fire automatic pistol or a semi-automatic pistol if the switch (53) is not used.

I claim:

1. An automatic pistol comprising: a frame with a magazine receiving grip; a slide including a breech-block at the rear;

a floating barrel and the slide, movable on the frame with the breech-block engagable over the barrel to form a cartridge chamber;

a spring loaded firing pin, with a foot at the rear projecting down, movable in the breech-block, away from and towards the barrel, between its rearmost position when it is out of the cartridge chamber and at the maximum extent of its travel to the rear of the breech-block, and its foremost position when it projects into the cartridge chamber, and including a rest position when it is fully contained within the breech-block between its rearmost and foremost positions;

a trigger provided with a safety lever and with a trigger bar pivotally connected, said trigger bar embodying, at its rearmost end, a plate with a face on its rearmost top corner and a triangular hole with an inclined edge within, and a web extending sideways from the plate, said web embodying a wing extending further sideways from the web and with a ledge extending rearward from the web, the trigger and the trigger bar being moveable between their foremost and rearmost positions, in the same directions as the firing pin;

an activating rod, embodying a foot and a groove, is transversely mounted in the frame and passes through the triangular hole in the plate of the trigger bar to co-act with the inclined edge within said hole to disengage the ledge from the foot of the firing pin when the trigger is in its rearmost position, said activating rod being transversely movable within the frame, on the slide's rearward movement, positioning the groove over the inclined edge for said edge to enter the groove and position the ledge into the path of the foot of the firing pin, a triggering mechanism including the trigger and the trigger bar, said trigger bar and the ledge having abutment means, are guided along their path by the inclined edge and the activating rod, said path being a gradually downward one towards the rear of the pistol characterised by the firing pin starting in its rest position with the ledge being positioned in front of the firing pin foot prior to the actuation of the trigger and the ledge being arranged to engage said foot to carry the firing pin in a rearward direction during the movement of the ledge along its path during activation of the trigger and to disengage from the foot, to release the firing pin to fire a cartridge, at the end of its movement when the trigger is in its rearmost position.

a select fire switch with an inclined edge is positioned at the rear of the breech-block in line with the plate of the trigger bar and is switchable to position its inclined edge in the path of the face of the plate for said ledge to strike the face and force the ledge of the trigger bar down to disengage the ledge of the trigger bar from the foot of the firing pin when the breech-block reaches its foremost position;

an ejector plate, for ejecting a cartridge, embodying a rectangular hole in its top edge to stabilise the ledge of the trigger bar as it is moved between its foremost and rearmost position;

a magazine drop safety plate embodying a hook to stop the trigger's rearward movement by engaging over the trigger bar when a magazine is fully or partially out of the frame;

an extractor, for extracting a cartridge from the chamber, embodying a ledge, a follower and a spring, said extractor being automatically retained in the breech-block.

2. The pistol defined in claim 1 wherein the firing pin has a foot projecting downward in the breech-block with a strong spring loaded on the rear for propelling said firing pin into the cartridge chamber and a weak spring loaded on the front of said firing pin to return same back to its rest position in the breech-block after firing a cartridge.

3. The pistol defined in claim 1 wherein the slide embodies a groove adjacent to the foot of the activating rod for the control of the transverse movement of the activating rod and, eventually, the trigger bar ledge in and out of the path of the firing pin foot as the slide is moved on the frame.

4. The pistol defined in claim 1 wherein the trigger bar has a spring positioned under the plate of said trigger bar to urge the inclined edge into contact with the activating rod when the slide is in its foremost position and the foot of the activating rod is in the groove in the slide, and to urge the ledge upwards into the path of the firing pin foot when the slide starts its rearward movement forcing the foot out of the groove.

5. The pistol defined in claim 1 wherein the activating rod has a spring bearing against the opposite end to its foot to urge said foot into the groove in the slide when said slide is in its foremost position.

6. The pistol defined in claim 1 wherein the trigger safety lever is pivotally connected on the back of the trigger and is directly engagable with the frame when the safety lever is activated to a position horizontal to the trigger, effectively stopping the rearward movement of the trigger.

7. The pistol defined in claim 1 wherein the frame embodies an upward projecting ledge adjacent to the ejector plate to co-act with same to embrace the wing to stop any disengagement between the ledge of the trigger bar and foot of the firing pin when the ledge of the trigger bar is in its foremost position.

8. The pistol defined in claim 1 wherein the ejector plate embodies a nose on its front to eject an empty cartridge, a rectangular hole to co-act with the projecting ledge in the frame, a hole for retaining the ejector in the frame and a hole for the activating rod to pass through said ejector plate.

9. The pistol defined in claim 1 wherein the breech-block embodies a cavity for the extractor and a blind hole at the back of said cavity to hold the spring and the follower which automatically retains the extractor in the cavity when the follower is urged over the ledge of said extractor by the spring in the blind hole, after the extractor has been fitted into the cavity.

10. The pistol defined in claim 1 wherein the magazine drop safety plate is urged by a spring hooked over its top edge, to hook over the trigger bar, said plate and spring being pivotally retained on the trigger retaining pin.

* * * * *